United States Patent [19]

Lilly

[11] 4,297,836

[45] Nov. 3, 1981

[54] GUARD FOR YARN TEXTURING MACHINE

[75] Inventor: James R. Lilly, Stoneville, N.C.

[73] Assignee: Burlington Industries, Inc., Greensboro, N.C.

[21] Appl. No.: 115,662

[22] Filed: Jan. 28, 1980

[51] Int. Cl.[3] ..... D01H 13/26

[52] U.S. Cl. ..... 57/291; 57/1 R

[58] Field of Search ..... 57/1, 279, 280, 284, 57/291, 334, 337, 338, 339, 340

[56] References Cited

U.S. PATENT DOCUMENTS

| | | | |
|---|---|---|---|
| 3,146,572 | 9/1964 | Keyser | 57/1 R |
| 3,422,617 | 1/1969 | Dudzik et al. | 57/284 |
| 4,036,000 | 7/1977 | Grieve | 57/1 R |
| 4,218,870 | 8/1980 | King | 57/284 |

*Primary Examiner*—Donald Watkins

*Attorney, Agent, or Firm*—Cushman, Darby & Cushman

[57] ABSTRACT

A textile yarn texturing machine having a bank of pairs of upright spindles rotated at high speed and having stacked thereon axially spaced meshing ceramic discs is provided with a fixed transparent shield disposed in front of the bank to protect an operator from flying pieces of the discs upon shattering thereof. The shield is spaced sufficiently forwardly of the spindles and has its lower edge high enough to permit an operator to reach thereunder to perform necessary manipulations in the area of the spindles.

3 Claims, 2 Drawing Figures

GUARD FOR YARN TEXTURING MACHINE

BACKGROUND OF THE INVENTION

This invention relates to machines for texturing textile yarns or threads, and more particularly, to an improved protective shield or guard for such machines which have intermeshing closely-spaced ceramic discs rotated at very high speed.

Certain types of yarn texturing machines are provided with a pair of parallel spindles. On each spindle is a stack of axially spaced ceramic discs. The discs on one spindle intermesh with the discs on the other spindle but when in proper adjustment the discs on one spindle, though closely spaced from those on the other spindle, do not touch the latter. The spindles are rotated at very high rpm's, e.g., 10,000 rpm, to impart a false twist to yarn in contact with the peripheries of the discs while being fed parallel to their axes.

One such type of machine presently in use is known as a Barmag machine. This machine has a long bank of pairs of upright spindles having intermeshing ceramic discs stacked thereon. In front of the bank are sliding transparent doors which can be opened to provide access for an operator to properly thread up the machine and to repair or tie broken yarns while most of the spindles continue to rotate.

As mentioned heretofore, the ceramic discs are rotated at very high speeds so that if they are cracked or otherwise damaged they may shatter and fly apart or disintegrate. In such an event, the broken ceramic pieces are hurled away with the speed of a projectile. If the above-described sliding doors are closed on such disintegration, an operator is safe, but if they are open, as when an operator is tying broken yarns, the operator is exposed to a most dangerous hazard. It has been found in practice that such disc disintegration is infrequent and normally will not occur when the discs are in proper adjustment so that the discs on one spindle do not touch those on the adjacent spindle. On the other hand, it has been found that when a disc on one spindle touches one on the other, disintegration very possibly can occur.

BRIEF SUMMARY OF THE INVENTION

Accordingly it is an objection of this invention to provide a textile yarn texturing machine, having ceramic discs stacked on spindles rotating at high speed, with a shield that provides continuous major protection for an operator against the hazard of disc disintegration.

It is another object of this invention to provide such a shield that is fixed in place and does not have to be moved in order to provide operator access to the spindle area.

It is a further object of this invention to provide such a shield that is simple to manufacture and install with resulting economies.

The foregoing objects are attained by the provision of a transparent sheet of strong plastic material which has its upper edge portion fastened to the machine above the spindle area and which extends forwardly and downwardly in front of the spindles to a level somewhat below the lowermost discs. The sheet is spaced forwardly of the discs sufficiently to enable an operator to insert his hands beneath the lower edge of the sheet and upwardly therebehind to manipulate yarns or tie broken ends. Thus, only the hands, wrists and a portion of the forearms of an operator are exposed to the hazard of flying bits of ceramic material which would occur on disintegration of a ceramic disc.

Other objects and advantages of the invention will become apparent from the following description and accompanying drawings in which:

DETAILED DESCRIPTION OF THE INVENTION

Figure 2:
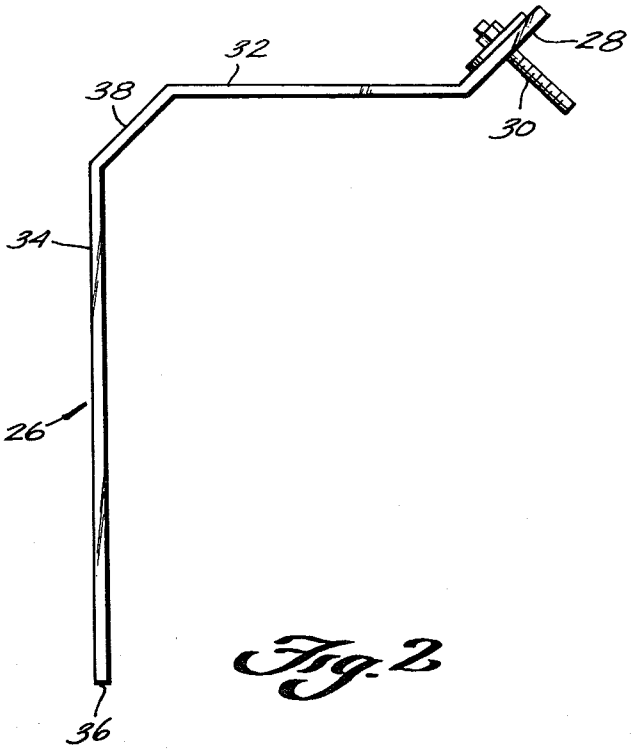
FIG. 2 is an end view of the shield shown in FIG. 1.
Figure 1:
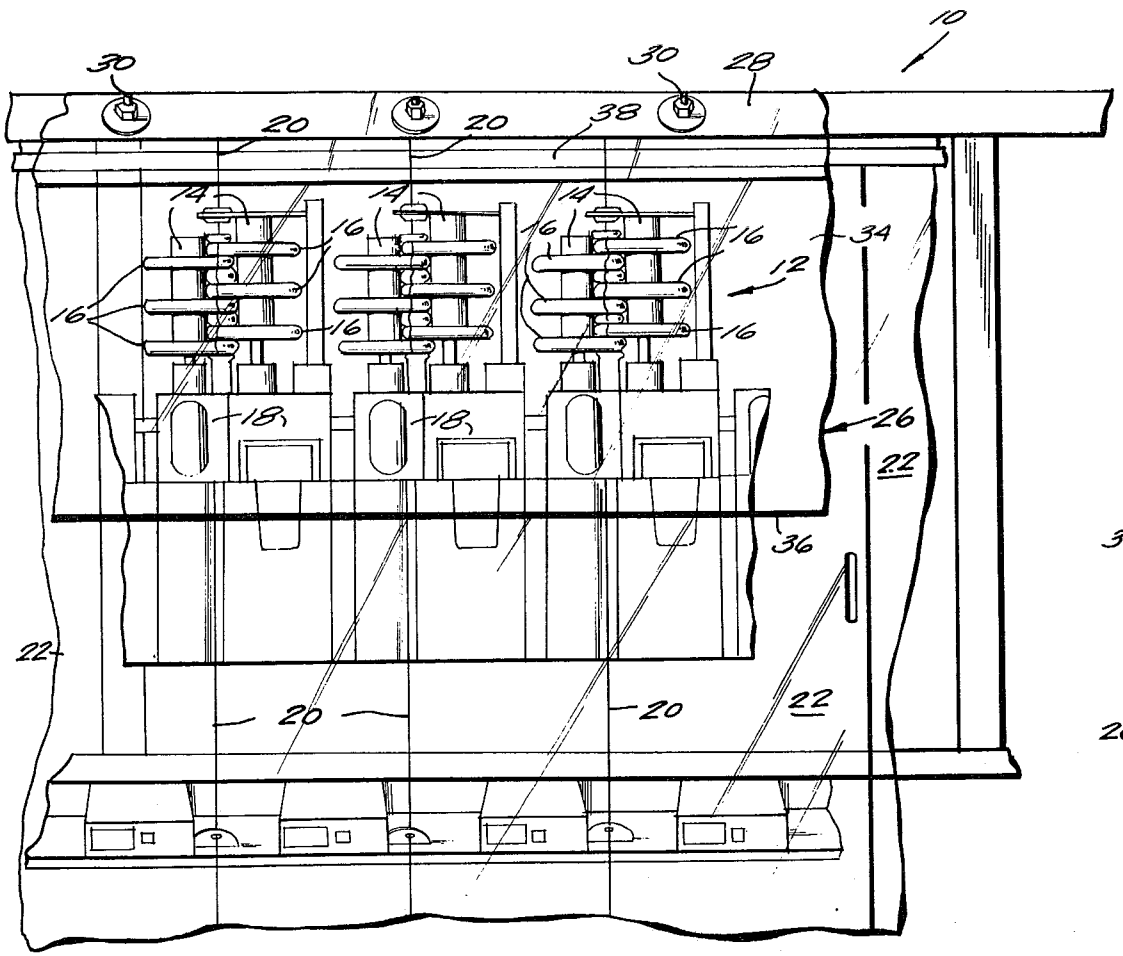
FIG. 1 is a fragmentary front elevational view of a textile yarn texturing machine provided with a protective shield in accordance with this invention.

Referring now to the drawings, there is shown a portion of a yarn texturing machine 10 having at its front a bank 12 of pairs of upright spindles 14 provided with stacks of axially-spaced ceramic discs 16, with the discs on one spindle intermeshing with those on an adjacent spindle. Enclosed drives 18 for each spindle pair rotate them at high speed, e.g., 10,000 rpm. A textile yarn 20 is fed vertically at the front of each spindle pair and in contact with the peripheries of the rotating intermeshing discs 16 to impart a false twist to the yarn. Suitable controls (not shown) for the drive 18 of each pair of spindles 14 enable an operator to disconnect such drive while threading up the yarn 20 or tying broken ends associated with such pair or while adjusting the spacing of discs 16 stacked on the spindles. Usually, however, the other pairs of spindles 14 in the bank 12 are allowed to continue to rotate while one pair is stopped for operator manipulations associated therewith.

In front of the bank 12 is a pair of horizontally sliding transparent upright doors 22 mounted and guided in an upper rail 24 and lower rail (not shown). The doors 22 are made of a strong transparent material, e.g., a suitable plastic. Normally the doors 22 are closed and opened only when an operator requires access to the spindle area. When open, however, an operator is completely exposed to the hazard of disc disintegration, as described above, and since the spindles 24 are at about head height the danger of serious injury is great.

In order to eliminate the danger of serious injury and minimize operator exposure to the hazard of disc disintegration, there is provided a shield or guard 26 which is fixed in place but provides operator access to the spindle area as required. The guard 26 comprises a sheet of strong transparent material, such as polycarbonate, desirably of the order of ¼ inch thick in order to withstand a blow from a piece of a shattered ceramic disc 16. The sheet extends the full length of the bank 12, which may be of the order of about 60 inches, and has an upper rear edge portion or flange 28 suitably secured to the upper rail 24, as by bolts and nuts 30. The upper surface of the upper rail 24 may be inclined upwardly and rearwardly at an angle of the order of 45°. If so, the fastening flange 28 of the shield 26 is correspondingly inclined to lie flat against such surface.

From the fastening flange 28, the shield has a forwardly extending horizontal portion 32 that terminates in a downwardly depending vertical portion 34 that is disposed in spaced relation with and in front of the spindle area, as shown in FIG. 2. The spacing between the depending portion 34 and the doors 22 is sufficient to permit free access to the spindle area, by reaching under the shield 26 with the hands, wrists and portions of the forearms of an operator standing in front of the machine, while maintaining such spacing at a minimum. A spacing of the order of 5 inches has been found to be sufficient for this purpose. The height of the depending portion 34 of the shield 26 is sufficient to cover the frontal area of the bank 12 to prevent a flying disc piece from striking any part of an operator except the hands, wrists and forearm portions mentioned above. The lower edge 36 of the shield 26 is high enough to enable an operator to reach thereunder for necessary manipulations in the spindle area. In actual practice, it has been found that a depending portion height of the order of about 8 inches will accomplish the foregoing objectives.

The horizontal and vertical portions 32 and 34 of the shield 26 may be joined by a relatively narrow portion 38 inclined at an angle of the order of about 45°, but this is not essential. Further, the shield 26 could consist of only the depending portion 34 which would be supported at its opposite ends by appropriate brackets (not shown) secured to the front of the machine 10 at each end of the bank 12 of spindles 14. This construction is not preferred, however, because the long length of such a shield would not be supported properly between its ends which could lead to possible sagging or undesirable deflections.

With both that construction and the construction shown, however, it will be seen that a flying piece of a shattered disc 16, flung horizontally outwardly on disintegration of a disc, will strike the depending portion 34 of the shield 26 without striking an operator except possibly his hands, wrists and forearm portions if they happen to be in the path of the flying piece. If the shield 26 has the inclined connecting portion 38 and a flying piece hits it, the piece will ricochet downwardly.

It thus will be seen that the depending portion 34 of the shield 26, which may include an inclined portion 38, protects an operator against serious injury, i.e., to the eyes, face and all head and throat areas, from flying pieces of a shattered disc 16. While the shield 26 does not prevent exposure of an operator's arms, wrists and forearm portions to such a hazard, injury to such parts is far less serious than to head and throat areas. Thus, the shield 26 positively minimizes the seriousness of possible injury to an operator arising from disintegration of a disc 16 while rotating at very high speed.

It thus will be seen that the objects and advantages of this invention have been fully and effectively achieved. It will be realized, however, that the foregoing specific embodiments have been disclosed only for the purpose of illustrating the principles of this invention and are susceptible of modification without departing from such principles. Accordingly, the invention includes all embodiments encompassed within the spirit and scope of the following claims.

I claim:

1. In a machine for texturing textile yarns provided at the front with a bank of pairs of upright spindles having axially spaced ceramic discs stacked thereon with the discs on one spindle of a pair intermeshing with those on the other spindle of the pair; the combination of a shield to prevent an operator from being struck in critical areas by flying pieces in the event a disc shatters during operation of the machine, comprising:

a transparent sheet of tough strong material disposed in front of and spaced from said bank, the area and location of said shield being such that any pieces of the ceramic discs flying forwardly in the event of disintegration of a disc will strike said shield, the spacing between said sheet and bank being sufficient to permit necessary manipulation in the spindle area by an operator standing in front of the machine, and the lower edge of said shield being high enough to permit an operator to reach thereunder to perform said manipulations; and means supporting said shield on the machine.

2. The structure defined in claim 1 in which the shield has a fastening flange along its upper rear edge and including means securing said flange to the machine.

3. The structure defined in claim 1 in which the shield has an upper horizontal portion secured to the machine and a portion depending from the front of said horizontal portion.

* * * * *